United States Patent [19]

McNamara

[11] Patent Number: 4,819,453

[45] Date of Patent: Apr. 11, 1989

[54] JEWELRY SETTING

[76] Inventor: Francis J. McNamara, 35 Jeffrey Pl., Manhasset Hills, N.Y. 11040

[21] Appl. No.: 79,587

[22] Filed: Jul. 30, 1987

[51] Int. Cl.[4] ..... A44C 17/02

[52] U.S. Cl. ..... 63/28; 63/26

[58] Field of Search ..... 63/28, 1 A, 26, 29 R, 63/29 M

[56] References Cited

U.S. PATENT DOCUMENTS

| | | | |
|---|---|---|---|
| 367,363 | 8/1887 | Chatellier | 63/28 |
| 758,847 | 5/1904 | Pejchar | 63/28 |
| 816,997 | 4/1906 | Pollard | 63/28 X |
| 1,328,948 | 1/1920 | Dover | 63/28 |
| 1,442,815 | 1/1923 | Maker et al. | 63/28 X |
| 1,854,958 | 4/1932 | Santosuósso | 63/28 |
| 2,056,705 | 10/1936 | Arpels | 63/28 |
| 2,132,905 | 10/1938 | Maynier | 63/28 |
| 2,419,520 | 4/1947 | Tessler | 63/28 |
| 3,931,719 | 1/1976 | Schwab | 63/28 |
| 4,392,289 | 7/1983 | Michaud | 63/28 X |
| 4,400,932 | 8/1983 | Epstein | 63/28 X |

FOREIGN PATENT DOCUMENTS

| | | | |
|---|---|---|---|
| 557624 | 8/1923 | France | 63/28 |

*Primary Examiner*—Kenneth J. Dorner
*Assistant Examiner*—Laurie K. Cranmer
*Attorney, Agent, or Firm*—Frishauf, Holtz, Goodman & Woodward

[57] ABSTRACT

A jewelry setting for holding at least one decorative gem stone comprises a frame having an upper surface bounded by side edges with at least one opening formed in the upper surface and sized to receive therein a lower surface of a decorative gem stone; and a housing having an opening bounded by sidewalls, each sidewall having a bottom portion and a top portion, the opening of said housing being sized to accommodate therein the frame between said sidewalls. The top portion of the sidewalls has a lip extending into the opening formed by the sidewalls, the lip having a surface facing downwardly toward the bottom portions of said sidewalls. A decorative gem stone mounted in the frame (which is received in the housing opening) has a lower surface supported in an opening of the frame and an upper surface in abutment with the downwardly facing surface of the lip to secure the decorative gem stone in the jewelry setting. The setting may be made in substantially any shape, depending upon desired use. The frame may be secured in the opening of the housing by, for example, soldering, to securely retain the gem stones in the setting. The lip of the housing preferably has cut outs, such as arcuate cut-outs, to better conform to the upper surfaces of the gem stones to provide better retention and appearance.

22 Claims, 2 Drawing Sheets

Fig. 1
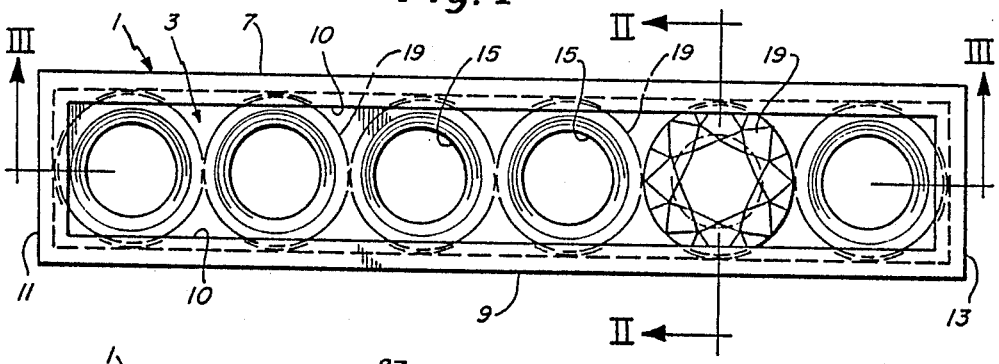
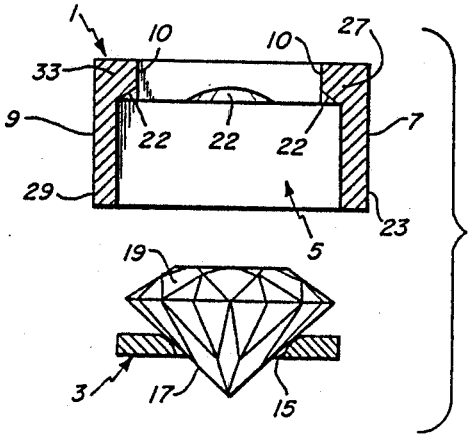
Fig. 2
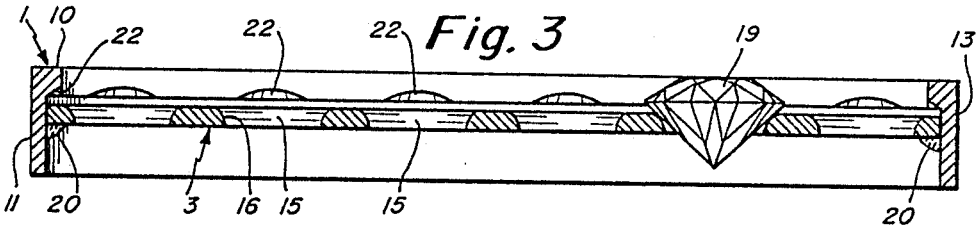
Fig. 3
Fig. 3A
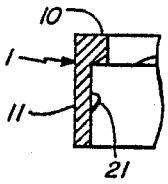
Fig. 3B
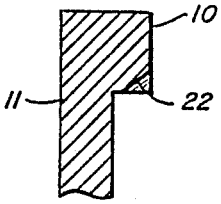
Fig. 3C
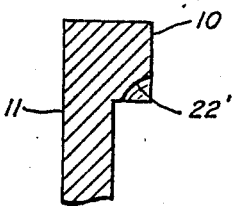

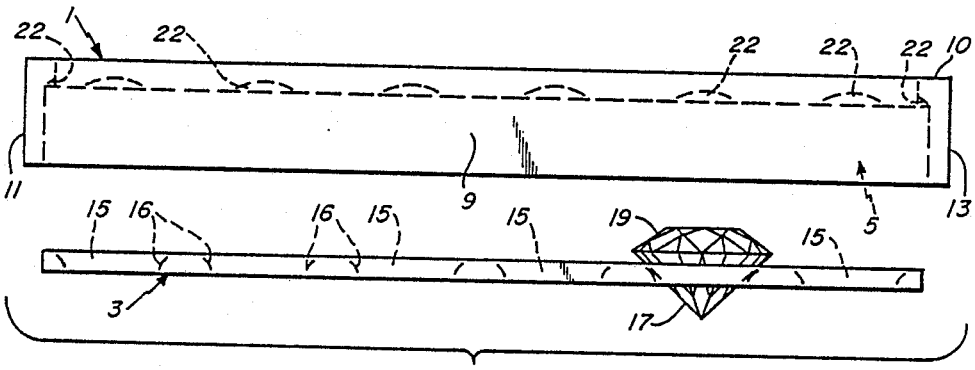
Fig. 4
Fig. 5
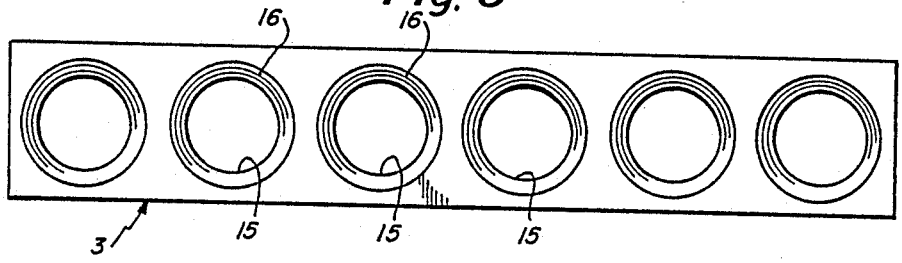
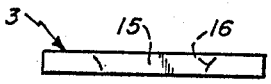
Fig. 6
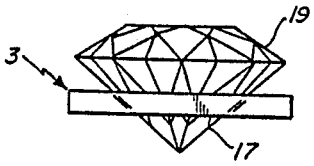
Fig. 7
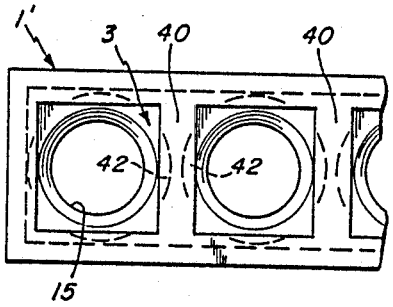
Fig. 8
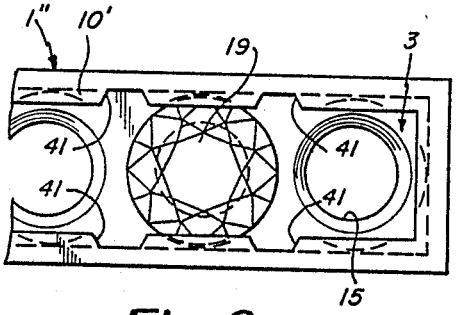
Fig. 9

JEWELRY SETTING

BACKGROUND OF THE INVENTION

This invention is directed to a jewelry setting for holding and securing decorative gem stones such as diamonds or other precious and/or decorative gem stones and, more particularly, to an assembly capable of holding and securing a plurality of diamonds or other gem stones in a frame-like setting without the need to separately manually secure each individual diamond or stone.

Throughout this application the decorative gem stones to be mounted in the subject setting will be referred to as diamonds, for convenience, it being understood that other precious, semi-precious or non-precious decorative gem stones could be used.

Diamonds are typically secured to a setting with prongs. A plurality of prongs, four or six, for example, are conventionally provided around the periphery of the diamond to fix it in position and to insure that it cannot move laterally. Each prong must be individually tightened against a side edge of the diamond so that it has no lateral motion. In addition, each prong tip is bent around the top of the diamond so that the prong tips grip the diamond. In order to adjust the prongs against the diamond so that it is secured in the fashion described just above, a laborious manual operation must be performed. Several time-consuming steps must be completed for each diamond. When a setting is to carry several diamonds, each and every diamond must have the same sequence of steps performed for it so that all of the diamonds are safely secured to the setting. Consequently, a considerable amount of manual labor is expended on a multiple-diamond piece of jewelry. This significantly adds to the time and cost required for producing jewelry.

It is a primary object of the present invention to provide a jewelry setting particularly suited for holding diamonds or the like, and which can be assembled quickly, easily, and reliably with relatively unskilled labor.

Another object of the present invention is to provide such a jewelry setting having a minimum number of parts.

A further object of the present invention is to provide such a jewelry setting which is relatively inexpensive and easy to manufacture.

Yet another object of the present invention is to provide such a jewelry setting which is decorative so as to enhance the appearance of the jewelry.

SUMMARY OF THE INVENTION

According to the present invention, a jewelry setting for holding at least one decorative gem stone comprises a frame having an upper surface bounded by side edges with at least one opening formed in said upper surface and sized to receive therein a lower surface of a decorative gem stone; and a housing having an opening bounded by sidewalls, each sidewall having a bottom portion and a top portion, said opening of said housing being sized to accommodate therein the frame between said sidewalls, said top portion of said sidewalls having a lip extending into said opening formed by said sidewalls, said lip having a surface facing downwardly toward said bottom portions of said sidewalls. A decorative gem stone mounted in said frame (which is received in said housing opening) has a lower surface supported in an opening of said frame and an upper surface in abutment with said downwardly facing surface of said lip to secure said decorative gem stone in said jewelry setting.

The setting may be made in substantially any shape, depending upon desired use.

The frame may be secured in the opening of the housing by, for example, soldering, to securely retain the gm stones in the setting.

The lip of the housing preferably has cut outs, such as arcuate cut-outs, to better conform to the upper surfaces of the gem stones to provide better retention and appearance.

BRIEF DESCRIPTION OF THE DRAWINGS

FIG. 1 is a plan view of an assembled jewelry setting according to the present invention in which several diamonds are mounted, only one diamond being fully shown, the other diamonds being represented by dashed lines.

FIG. 2 is a cross-sectional view thereof taken along line II—II in FIG. 1.

FIG. 3 is a cross-sectional view thereof taken along line III—III in FIG. 1.

FIG. 3A a modification to the embodiment of FIG. 3.

FIG. 3B is an enlarged view of a portion of FIG. 3

FIG. 3C shows a modification to the portions shown in FIG. 3B.

FIG. 4 is a side view thereof shown in a partly disassembled condition.

FIG. 5 is a top view of the plate-like frame of the present invention.

FIG. 6 is an end view of the plate-like frame of FIG. 5.

FIG. 7 is an end view of a modified plate-like frame, similar to that of FIG. 5.

FIG. 8 is a partial top view of a modified embodiment of the invention.

FIG. 9 a partial top view of a another modified embodiment of the invention.

DETAILED DESCRIPTION

An assembly for a jewelry setting in accordance with the present invention includes two parts, namely a housing 1, and a plate-like holding and retaining frame 3 which is retained in the housing 1. As best shown in FIGS. 1–4, housing 1 comprises integrally formed sidewalls 7, 9, 11, 13 defining an opening 5 therebetween. The housing also has an upper inwardly extending lip 10. Although housing 1 is shown to have a rectangular shape, this is merely for ease of illustration. Other shapes, such as an arc shape, circular shape, square shape, etc., can be selected also, as will become apparent from the description provided below.

Plate-like frame 3 is substantially flat and is elongated so as to fit within the opening 5 of housing 1. Diamond receiving openings 15 are formed at spaced intervals along the length of retaining frame 3. As best seen in FIGS. 4 and 5, openings 15 have inclined side walls or surfaces 16 which can be curved as shown in FIGS. 4 and 6, or substantially flat as shown in FIG. 7 to define a generally frustoconical shape for receiving therein a lower generally conical surface of a cut diamond or other gem stone. The important feature is that the wide upper portion of the openings 15 taper down to narrow openings at the underside of frame 3. These shapes are particularly well suited for retaining therein the inclined bottom surfaces 17 of a cut diamond 19 as shown in FIGS. 2 and 4. In this manner, the diamond 19 is seated on sidewall 16 of a respective tapered opening 15. The exact sizes of tapered openings 15 and the curve and/or taper angle of walls 16 can be customized for the bottom surfaces 17 of a particular diamond 19 or a particular size of diamonds. While only one diamond 19 is shown mounted to frame 3 in FIGS. 1–4, respective diamonds are also mounted in the other openings 15.

Sidewalls 7, 9 of housing 1 are shaped on their respective interior surfaces so that frame 3 carrying one or more diamonds 19 mounted therein is relatively snugly fit within opening 5 of housing 1. More specifically, as shown in FIG. 2, sidewall 7 of housing 1 includes a bottom portion 23 and a top portion 27 carrying the inwardly directed lip or shoulder 10. Similarly, the sidewall 9 which faces sidewall 7 includes a bottom portion 29 and a top portion 33 carrying the lip or shoulder 10. Opposing inner surfaces of bottom wall portions 23 and 29 are preferably substantially straight and relatively smooth in the vertical direction. The spacing between the inner surfaces of bottom portions 23 and 29 of side walls 7 and 9 is such as to admit frame 3 to pass therebetween. Frame 3 (with diamonds or the like mounted in the holes 15 thereof) is inserted into the housing opening 5 from the bottom of housing 1 and is moved upwardly toward lip or shoulder 10. Frame 3 is moved up into the opening 5 until the upper surfaces of the diamonds or the like mounted therein abut against the inner downwardly facing surfaces of the lip or shoulder 10 (see FIG. 3). Further upward movement of frame 3 within housing 1 is thus blocked. The frame 3 is then preferably soldered at the underside of frame 3 to housing 1 where it adjoins walls 7, 9, 11 and 13 of housing 1, to secure it in position and to prevent downward movement of frame 3 relative to housing 1. The solder connection is shown at 20 in FIG. 3. The solder 20 can be at small separated portions, or can extend along the complete interface between housing 1 and frame 3. This securely and permanently locks the diamonds or other gem stones 19 in place in a decorative manner. Alternatively, the fit between frame 3 and housing 1 can be made so tight that the frame 3 is press fit into housing 1 and, thereby, securely retained therein.

As shown in FIG. 3A, instead of providing a solder connection between the frame 3 and housing 1, one or more sidewalls of the housing 1 can have a small projection (similar to a 'dimple') 21 over which the frame 3 i passed when being inserted into the housing 1. Since the frame 3 is snuggly fit within the housing 1, it must be forced past the dimple 21 and snapped thereover, whereafter the dimple then projects below the frame 3 to lock frame 3 into the housing. The inner surfaces of the sidewalls can be provided with spaced-apart dimples 21, or an elongated ledge-like projection could be used. Preferably, the lower surface of the dimple 21 is inclined to facilitate passing of the frame 3 thereover. The projection 21 could be provided on an edge of the frame 3 so as to be receivable in recesses in the inner walls of sidewalls 7, 9, 11 and/or 13.

As best seen in FIGS. 2, 3, and 4, the lip or shoulder 10 of each of the sidewalls of the housing 1 has cut-out portions or recesses 22 therein. The cut-portions 22 correspond to the positions of the gem stones. Preferably, the cut-out portions are circular portions so as to receive the upper surface of a cut gem stone 19 therein. By curving the surfaces of the cut-out portions 22, a closer fit to the upper surface of the gem stone 19 is provided, thereby preventing shaking or wobbling of the gem stones when they are installed into the setting of the present invention. As shown in FIGS. 2 and 4, the cut-out portions 22 are not only curved (see the cut-out portions 22 in sidewalls 7) as seen in FIG. 4, but they are also inclined, as shown by the illustration of the cut-out portions 22 in sidewalls 23 and 29 in FIGS. 2, 3 and 3A. This is more clearly seen by the enlarged view of a portion of sidewall 11 in FIG. 3B.

The exact shape of the cut-out portions 22 is not critical, as long as the lateral motion of diamond or gem stone 19 is arrested when it is mounted in the setting. The lower facing surfaces of the cut-out portions 22 should sufficiently bear against the slanted facets of the diamond or gem stone 19, as seen in FIG. 3. The lower facing surfaces of cut-out portions or recesses 22 preferably contact the upper surface of the diamond at least at two points on opposite sides of the transverse section line II—II in FIG. 1. This effectively holds the diamond and prevents tilting thereof. Preferably, when the cut-out portions are circular or part-circular, they should be concentric with the openings 15 in the frame 3. This provides better alignment when the setting is assembled. Arcuate shapes for the cut-out portions 22 are preferred, but this is not critical. The significant aspect of the cut-out portions 22 is that they tilt inwardly toward the opening or channel 5 of the housing 1 in the manner depicted in the drawings so that the downwardly facing surfaces thereof bear against upper, tapered facets of the diamond or gem stone 19, in order to prevent the diamond or gem stone 19 from moving upward because of abutment with the upper surface of the diamond or gem stone, and in order to prevent side or lateral movement of the diamond by abutment therewith.

Housing 1 and frame 3 can be produced in a variety of shapes and sizes, and from various types of materials to enhance the decorative effect of the jewelry piece. However, any such assembly must include a suitably shaped frame such as frame 3 with openings for accommodating the diamonds or other gem stones. If different-sized stones are utilized, then the openings 15 in the frame 3 must be formed to accommodate the particular diamonds selected. However, this is a straightforward machining operation which lends itself to mass production. Frame 3 thus supports diamonds 19 from underneath. Opening 5 in housing 1 must be sized to accommodate the frame 3 with diamonds 19 mounted therein. Finally, a downward facing surface must be provided in opening 5 which abuts against an upward facing surface of the diamonds 19 so that the diamonds are securely retained between the frame 3 and housing 1.

Frame 3 may be formed of a relatively inexpensive metal if the diamonds are positioned so densely that the frame 3 is not seen in the finished jewelry piece. Otherwise, frame 3 can be made from a decorative material, such as gold. Openings 15 are formed therein (for example by drilling or being molded or cast therein) and diamonds are then seated in frame 3. With all of diamonds 19 having been placed in frame 3, frame 3 is inserted from the bottom of housing 1 and pressed upward until the diamonds or other stones engage the downward facing surfaces of shoulders 27, 33. Then, the frame 3 is secured to housing 1, for example by soldering. This can be done by relatively unskilled labor. Diamonds of different sizes can be accommodated by adjusting the size of openings 15 so that the diamonds project more or less, depending upon size thereof, above frame 3. With the assembly configured in this manner, diamonds 19 are securely retained between frame 3 and the downward facing surfaces of the lips or shoulders of the housing 1. Lateral movement of diamonds 19 is prevented by the shape of recess or cut-out portions 22 which engage the peripheral upper surfaces of diamonds 19.

FIGS. 8 and 9 illustrate modified embodiments of the housing of the present invention. As shown in FIG. 8, the housing 1' has cross-members 40 which extend from the lip portions thereof so as to effectively "box in" the tops of the gem stones. Alternatively, as shown in FIG. 9, the housing 1'' may have notches or other cut-out portions 41 in the lip 10' to add a decorative effect. As should be clear, there is no requirement that the housing be as shown in FIG. 1, but it can be in various different shapes, so long as it has the retaining lips for engaging at least a portion of the upper surface of a gem stone to retain the gem stone in position. In the FIG. 8 embodiment, the cross members 40 preferably have cut-out portions 42 therein which are similar to the cut-out portions 22 shown in FIG. 3, to conform to the shape of the gem stone. Other variations in design of the housing can be made, as desired, to provide desired decorative effects.

Although preferred embodiments of the invention have been disclosed above, a number of changes will be readily apparent. Cut-out portions or recesses 22 need not be defined by a straight wall which slants inward in the manner shown in FIG. 3B. Instead, such wall can be curved as shown at 22 in FIG. 3C, or it can be vertical.

In such a case, the shoulders 10 serve to prevent upward motion of diamond 19 in housing 3. In addition, the shape of recess 22 need not be arcuate or part-circular. Other shapes which provide surfaces which press against the upper periphery of diamond 19 when mounted in the setting, to provide the requisite lateral support, can be used. Furthermore, frame 3 can be retained within housing 1 by various means rather than by the soldering as disclosed above. For example, resilient projections can be affixed to the interior surfaces of walls 7 and 9 which can be deformed as frame 3 passes between them but which will spring back to normal shape to thereby retain frame 3 above them.

These and other modifications are all intended to fall within the scope of the present invention as defined by the following claims.

I claim:

1. A jewelry setting for holding at least one decoration gem stone comprising:

a frame (3) having an upper surface bounded by side edges and having a plurality of openings (15) formed in said upper surface, said openings (15) each being seized to receive herein a lower surface of a respective decoration gem stone (19); and a housing (1) having an opening (5) bounded by sidewalls (7, 9, 11, 13), each sidewall having a bottom portion and a top portion, said opening (5) of said housing (1) being sized to accommodate therein the frame (3) between said sidewalls, said top portions of said sidewalls having a lip (10) extending into said opening (5) formed by said sidewalls, each of said lips (10) being above said frame (3) and having a surface facing downwardly toward said frame and said bottom portions of said sidewalls, and said downwardly facing surfaces being adapted to contact an upper surface of said gem stones (19) received in said openings (15) of said frame (3);

said lip (10) of at least two of said sidewalls including a plurality of downwardly facing cut-out portions or recesses (22) formed in said downwardly facing surfaces thereof, said cut-out portions or recesses (22) having surfaces which face and are unobstructedly open toward said bottom portion;

said cut-out portions or recesses (22) being positioned and sized to accommodate therein a peripheral upper surface portion of a respective one of said gem stones (19) which is mounted in said frame (3), the surfaces of each of said cut-out portions or recesses abutting and contacting said upper peripheral surface of said respective gem stones at least at two spaced apart points on the upper peripheral surface of said respective gem stones without contacting lower surfaces of said respective gem stones;

whereby gem stones (19) mounted in said frame (3) have a lower surface supported in an opening (15) of said frame (3) and an upper surface in abutment with said downwardly facing surfaces of said cut-out portions or recesses to thereby secure and substantially immovably retain said gem stones (19) between said frame and said lips in said jewelry setting.

2. The jewelry setting of claim 1, wherein said openings (15) of said frame (3) are frustoconical.

3. The jewelry setting of claim 2, wherein said openings (15) of said frame (3) extend through said frame.

4. The jewelry setting of claim 1, wherein said openings (15) of said frame (3) extend through said frame.

5. The jewelry setting of claim 1, wherein said openings (15) of said frame (3) have tapered walls (16) defining said openings.

6. The jewelry setting of claim 5, wherein said tapered walls (16) are convexly curved into said opening (15).

7. The jewelry setting of claim 1, wherein said cut-out portions or recesses (22) are shaped at a taper to conform to, and abut against, a facet of said gem stone.

8. The jewelry setting of claim 1, wherein said frame (3) and said housing (1) are elongated.

9. The jewelry setting of claim 8, wherein at least two of said sidewalls are substantially parallel to each other.

10. The jewelry setting of claim 9, further comprising means for securing said frame to said housing.

11. The jewelry setting of claim 1, further comprising means for securing said frame to said housing.

12. The jewelry setting of claim 11, wherein said securing means comprises surfaces of at least two of said sidewalls (7, 9) frictionally engaging said frame (3).

13. The jewelry setting of claim 11, wherein said securing means comprises solder (20) connecting said frame (3) to said housing (1).

14. The jewelry setting of claim 11, wherein said securing means comprises at least one projection (21) on a sidewall of said housing, over which said frame (3) is forcingly passed when said frame (3) is inserted in said opening (5) of said housing (1).

15. The jewelry setting of claim 14, wherein said at least one projection is positioned so as to be below said frame (3) when it is fully received in said housing (1).

16. The jewelry setting of claim 1, wherein said cut-out portions or recesses (22) are arcuately shaped so as to provide said at least two contact points with an upper surface of said gem stone received therein.

17. The jewelry setting of claim 1, wherein said cut-out portions or recesses (22) are curved so as to provide said at least two contact points with an upper surface of said gem stone received therein.

18. The jewelry setting of claim 1, wherein said cut-out portions or recesses (22) are concave in a direction facing downwardly.

19. The jewelry setting of claim 1, wherein said cut-out portions or recesses (22) are formed in said lips (10) of each of said sidewalls.

20. The jewelry setting of claim 19, wherein said cut-out portions or recesses (22) are concave in a direction facing downwardly.

21. The jewelry setting for holding at least one decorative gem stone comprising:

a frame (3) having an upper surface bounded by opposing edges and having a plurality of openings (15) formed in said upper surface, said openings (15) each being sized to receive therein a lower surface of a respective decoration gem stone (19); and a housing (1) having an opening (5) bounded by at least two sidewalls (7, 9, 11, 13), each sidewall having a bottom portion and a top portion, said opening (5) of said housing (1) being sized to accommodate therein the frame (3) between said sidewalls, said top portions of said sidewalls having a lip (10) extending into said opening (5) formed by said sidewalls, each of said lips (10) being above said frame (3) and having a surface facing downwardly toward said frame and said bottom portions of said sidewalls, and said downwardly facing surfaces being adapted to contact an upper surface of said gem stones (19) received in said openings (15) of said frame (3);

said lip (10) of said at least two sidewalls including a plurality of downwardly facing cut-out portions or recesses (22) formed in said downwardly facing surfaces thereof, said cut-out portions or recesses (22) having surfaces which face and are unobstructedly open toward said bottom portion;

said cut-out portions or recesses (22) being positioned and sized to accommodate therein a peripheral upper surface portion of a respective one of said gem stones (!9) which is mounted in said frame (3), the surface of each of said cut-out portions or recesses abutting and contacting said upper peripheral surface of said respective gem stones at least at two spaced apart points on the upper peripheral surface of said respective gem stones without contacting lower surfaces of said respective gem stones;

whereby gem stones (19) mounted in said frame (3) have a lower surface supported in an opening (15) of said frame (3) and an upper surface in abutment with said downwardly facing surfaces of at least two of said cut-out portions or recesses to thereby secure and substantially immovable retain said gem stones (19) between said frame and said lips in said jewelry setting.

22. The jewelry setting of claim 21, wherein said cut-out portions or recesses (22) are curved so as to provide said at least two contact points with an upper surface of said gem stone received therein.

* * * * *